US007950473B2

(12) United States Patent
Sugiura

(10) Patent No.: US 7,950,473 B2
(45) Date of Patent: May 31, 2011

(54) NON-AZIMUTHAL AND AZIMUTHAL FORMATION EVALUATION MEASUREMENT IN A SLOWLY ROTATING HOUSING

(75) Inventor: Junichi Sugiura, Houston, TX (US)

(73) Assignee: Smith International, Inc., Houston, TX (US)

( * ) Notice: Subject to any disclaimer, the term of this patent is extended or adjusted under 35 U.S.C. 154(b) by 261 days.

(21) Appl. No.: 12/276,485

(22) Filed: Nov. 24, 2008

(65) Prior Publication Data

US 2010/0126770 A1 May 27, 2010

(51) Int. Cl.
*E21B 47/022* (2006.01)
*E21B 7/04* (2006.01)

(52) U.S. Cl. ..... 175/45; 175/50; 175/61; 175/73; 175/76

(58) Field of Classification Search ..... 175/45, 175/50, 61, 73, 76
See application file for complete search history.

(56) References Cited

U.S. PATENT DOCUMENTS

| | | | |
|---|---|---|---|
| 2,373,880 | A | 4/1945 | Driscoll |
| 2,603,163 | A | 7/1952 | Nixon |
| 2,874,783 | A | 2/1959 | Haines |
| 2,880,805 | A | 4/1959 | Nelson at al. |
| 2,915,011 | A | 12/1959 | Hamill |
| 4,407,374 | A | 10/1983 | Wallussek et al. |
| 4,416,339 | A | 11/1983 | Baker et al. |
| 4,463,814 | A | 8/1984 | Horstmeyer et al. |
| 4,844,178 | A | 7/1989 | Cendre et al. |
| 4,947,944 | A | 8/1990 | Coltman et al. |
| 4,957,173 | A | 9/1990 | Kinnan |
| 5,070,950 | A | 12/1991 | Cendre et al. |
| 5,168,941 | A | 12/1992 | Krueger et al. |
| 5,341,886 | A | 8/1994 | Patton |
| 5,473,158 | A | 12/1995 | Holenka et al. |
| 5,603,386 | A | 2/1997 | Webster |
| 5,797,453 | A | 8/1998 | Hisaw |
| 5,941,323 | A | 8/1999 | Warren |
| 6,088,294 | A | 7/2000 | Leggett, III |
| 6,148,933 | A | 11/2000 | Hay et al. |
| 6,158,529 | A | 12/2000 | Dorel |
| 6,215,120 | B1 | 4/2001 | Gadeken et al. |

(Continued)

FOREIGN PATENT DOCUMENTS

EP 1174582 A3 1/2002

(Continued)

OTHER PUBLICATIONS

Comeaux, B.C., et al.; "Implementation of a next generation rotary steerable system"; AADE National Drilling Technical Conference, 2001, AADE 01-NC-HO-25.

(Continued)

*Primary Examiner* — Giovanna C Wright

(57) ABSTRACT

A steering tool configured for making azimuthal and non-azimuthal formation evaluation measurements is disclosed. In one embodiment a rotary steerable tool includes at least one formation evaluation sensor deployed in the steering tool housing. The steering tool may include, for example, first and second circumferentially opposed formation evaluation sensors or first, second, and third formation evaluation sensors, each of which is radially offset and circumferentially aligned with a corresponding one of the steering tool blades. The invention further includes methods for geosteering in which a rotation rate of the steering tool housing in the borehole (and therefore the rotation rate of the formation evaluation sensors) is controlled. Steering decisions may be made utilizing the formation evaluation measurements and/or derived borehole images.

29 Claims, 5 Drawing Sheets

U.S. PATENT DOCUMENTS

| | | | |
|---|---|---|---|
| 6,233,524 | B1 | 5/2001 | Harrell et al. |
| 6,257,356 | B1 | 7/2001 | Wassell |
| 6,290,003 | B1 | 9/2001 | Russell |
| 6,300,624 | B1 | 10/2001 | Yoo |
| 6,307,199 | B1 | 10/2001 | Edwards et al. |
| 6,405,136 | B1 | 6/2002 | Li et al. |
| 6,427,783 | B2 | 8/2002 | Krueger et al. |
| 6,516,898 | B1 | 2/2003 | Krueger et al. |
| 6,584,837 | B2 | 7/2003 | Kurkoski |
| 6,609,579 | B2 | 8/2003 | Krueger et al. |
| 6,696,684 | B2 | 2/2004 | Radtke et al. |
| 6,742,604 | B2 | 6/2004 | Brazil et al. |
| 6,761,232 | B2 | 7/2004 | Moody et al. |
| 6,944,548 | B2 | 9/2005 | Radtke et al. |
| 6,957,145 | B2 | 10/2005 | Spross |
| 7,027,926 | B2 | 4/2006 | Haugland |
| 7,188,689 | B2 | 3/2007 | Maxwell et al. |
| 7,195,062 | B2 | 3/2007 | Cairns et al. |
| 7,200,492 | B2 | 4/2007 | Hassan et al. |
| 7,222,681 | B2 | 5/2007 | Jones et al. |
| 7,234,540 | B2 | 6/2007 | Estes et al. |
| 7,245,229 | B2 | 7/2007 | Baron et al. |
| 7,426,967 | B2 | 9/2008 | Sugiura |
| 2001/0042643 | A1 | 11/2001 | Krueger et al. |
| 2005/0189946 | A1* | 9/2005 | Moore ..... 324/338 |
| 2006/0185902 | A1 | 8/2006 | Song et al. |
| 2006/0208738 | A1* | 9/2006 | Moore ..... 324/344 |

FOREIGN PATENT DOCUMENTS

| | | | |
|---|---|---|---|
| WO | WO-98-34003 | A1 | 8/1998 |
| WO | WO-00-28188 | A1 | 5/2000 |
| WO | WO-01-51761 | A1 | 7/2001 |
| WO | WO-03-097989 | A1 | 11/2003 |

OTHER PUBLICATIONS

Sperry Drilling Services, ABG (At-Bit Gamma) sensor; Real-time geosteering with the Geo-Pilot rotary steering system; http://www.halliburton.com/public/ss/contents/Date_Sheets/web/H03932.pdf.

International Search Report dated May 9, 2010 for corresponding PCT application No. PCT/US2009/065473 filed Nov. 23, 2009.

* cited by examiner

NON-AZIMUTHAL AND AZIMUTHAL FORMATION EVALUATION MEASUREMENT IN A SLOWLY ROTATING HOUSING

RELATED APPLICATIONS

None.

FIELD OF THE INVENTION

The present invention relates generally to downhole tools, for example, including directional drilling tools such as three-dimensional rotary steerable tools (3DRS). More particularly, embodiments of this invention relate to rotary steerable tools having formation evaluation sensors deployed in an outer housing thereof. The invention further relates to geosteering methods.

BACKGROUND OF THE INVENTION

Logging while drilling (LWD) techniques for determining numerous borehole and formation characteristics are well known in oil drilling and production applications. Such logging techniques include, for example, natural gamma ray, spectral density, neutron density, inductive and galvanic resistivity, micro-resistivity, acoustic velocity, acoustic caliper, physical caliper, downhole pressure, and the like. Formations having recoverable hydrocarbons typically include certain well-known physical properties, for example, resistivity, porosity (density), and acoustic velocity values in a certain range. Such LWD measurements (also referred to herein as formation evaluation measurements) may be used, for example, in making steering decisions for subsequent drilling of the borehole.

LWD sensors (also referred to herein as formation evaluation or FE sensors) are commonly used to measure physical properties of the formations through which a borehole traverses. Such sensors are typically deployed in a rotating section of the bottom hole assembly (BHA) whose rotational speed is substantially the same as the rotational speed of the drill string. LWD imaging and geo-steering applications commonly make use of focused FE sensors and the rotation (turning) of the BHA (and therefore the FE sensors) during drilling of the borehole. For example, in a common geo-steering application, a section of a borehole may be routed through a thin oil bearing layer (sometimes referred to in the art as a payzone). Due to the dips and faults that may occur in the various layers that make up the strata, the drill bit may sporadically exit the oil-bearing layer and enter nonproductive zones during drilling. In attempting to steer the drill bit back into the oil-bearing layer (or to prevent the drill bit from exiting the oil-bearing layer), an operator typically needs to know in which direction to turn the drill bit (e.g., up or down). Such information may be obtained, for example, from azimuthally sensitive measurements of the formation properties.

One drawback associated with the above described configuration (in which the FE sensors are rotationally coupled to the drill string) is that the vibration and shock sensitive FE sensors are subject to high lateral, axial, and torsional vibrations during normal drilling operations. Conventional FE sensor deployments are known to be susceptible to vibration and shock related errors and failures. Another drawback associated with the above-described conventional FE sensor deployments is that azimuthal logging techniques require a substantially uniform drill string rotation rate during drilling in order to suitably reduce statistical errors in the azimuthally focused logging data. While the above-mentioned conventional deployments are serviceable, and have been commercially utilized, an improved apparatus and method for acquiring near-bit formation evaluation sensor measurements is needed. In particular, there is a need for an apparatus that is less susceptible to shock and vibration related errors and failures and that is capable of providing both azimuthally focused and non-azimuthally focused formation evaluation sensor measurements.

SUMMARY OF THE INVENTION

The present invention addresses the need for improved formation evaluation sensor deployments and improved geosteering methods. Aspects of this invention include rotary steerable deployments including at least one (and preferably a plurality of) formation evaluation sensor(s) deployed in the steering tool housing. In one preferred embodiment, the steering tool housing includes at least first and second circumferentially opposed gamma ray sensors. In a second preferred embodiment, the steering tool includes at least first, second, and third neutron density sensors, each of which is radially offset and circumferentially aligned with a corresponding one of the steering tool blades. The invention further includes methods for geosteering in which a rotation rate of the steering tool housing in the borehole (and therefore the rotation rate of the formation evaluation sensors) is controlled via controlling blade force. The rotation rate may be controlled, for example, so as to promote formation evaluation measurements at or near predetermined tool face angles. The rotation rate may also be controlled so as to enable borehole imaging. Steering decisions may then be made utilizing the formation evaluation measurements and/or derived borehole images.

Exemplary embodiments of the present invention may advantageously provide several technical advantages. For example, deployment of the formation evaluation sensors in the steering tool housing has been found to reduce both shock and vibration exposure and therefore tends to minimize shock and/or vibration related errors and/or failures. Exemplary steering tool embodiments of the invention also advantageously provide for both azimuthal (focused) and non-azimuthal (non-focused) formation evaluation measurements. Exemplary steering tool embodiments of the invention may also provide for simultaneous formation evaluation and physical standoff measurements. Such physical standoff measurements tend to be more reliable than conventional ultrasonic standoff measurements and may be utilized to interpret the formation evaluation measurements (e.g., neutron density measurements).

The invention further provides near-bit, azimuthally resolved formation evaluation measurements which may be utilized, for example, in geosteering applications. The use of azimuthally resolved formation evaluation measurements in geosteering tends to advantageously optimize wellbore placement and reduce dependence on pre-well geological models. Such models are known to be limited by the resolution of seismic data and commonly fail to include faults and other complex geological features (even when correlated with nearby offset wells). Thus, the invention may also provide for improved wellbore placement in geosteering applications.

The invention also advantageously provides a method for controlling the rotation rate of the steering tool housing in the borehole during drilling (e.g., in the range of from about 0.1 to about 30 revolutions per hour). Since the formation evaluation sensor(s) are deployed in the steering tool housing, the invention also advantageously enables the rate at which these sensors rotate in the borehole to be controlled. Controlling the rotation rate of the housing advantageously enables the sensors to be maintained at a desired orientation (e.g., in high side or low side quadrants) for longer periods of time than an undesirable orientation (e.g., in left side or right side quadrants). Such control tends to be advantageous in geosteering applications.

Moreover, controlling the rotation rate of the steering tool housing advantageously enables borehole images (images based on formation evaluation measurements) to be acquired. Such borehole images may also be advantageously utilized in geosteering applications.

In one aspect the present invention includes a downhole steering tool configured to operate in a borehole. The steering tool includes a shaft deployed substantially coaxially in a housing, the shaft and the housing being free to rotate relative to one another about a longitudinal axis of the steering tool. A plurality of blades are deployed on the housing. The blades are disposed to extend radially outward from the housing and engage a wall of the borehole, said engagement of the blades with the borehole wall operative to eccenter the housing in the borehole. A plurality of circumferentially spaced formation evaluation sensors are deployed in the housing, each of the formation evaluation sensors being configured to individually provide a corresponding azimuthally focused sensor response. The plurality of formation evaluation sensors are further configured to collectively provide a non-azimuthally focused sensor response. A controller is configured to acquire sensor data from the formation evaluation sensors and to compute both azimuthally focused and non-azimuthally focused formation evaluation measurements.

In another aspect this invention includes a downhole steering tool configured to operate in a borehole. The steering tool includes a shaft deployed substantially coaxially in a housing, the shaft and the housing being free to rotate relative to one another about a longitudinal axis of the steering tool. At least first, second, and third blades are deployed on the housing. The blades are disposed to extend radially outward from the housing and engage a wall of the borehole, said engagement of the blades with the borehole wall operative to eccenter the housing in the borehole. At least first, second, and third circumferentially spaced formation evaluation sensors are deployed in the housing. Each of the first, second, and third formation evaluation sensors is axially spaced from and circumferentially aligned with a corresponding one of the first, second, and third blades. A controller is configured to compute a standoff distance at each of the formation evaluation sensors based on a radial position of the corresponding blades.

In another aspect the present invention includes a method for geosteering. The method includes deploying a steering tool in a subterranean borehole. The steering tool includes a housing deployed about a shaft, the housing and the shaft free to rotate relative to one another about a longitudinal axis of the steering tool. A plurality of blades are deployed on the housing, the blades disposed to extend radially outward from the housing and engage a wall of the borehole, said engagement of the blades with the borehole wall operative to eccenter the housing in the borehole. The steering tool housing further includes at least one formation evaluation sensor and a tool face sensor deployed therein; The method further includes causing the tool face sensor to measure a tool face angle of the formation evaluation sensor; processing the measured tool face angle to determine a target rotation rate of the housing in the borehole, and causing the housing to rotate in the borehole at about the target rotation rate.

In still another aspect the present invention includes a method for geosteering. The method includes deploying a steering tool in a subterranean borehole. The steering tool includes a housing deployed about a shaft, the housing and the shaft free to rotate relative to one another about a longitudinal axis of the steering tool. A plurality of hydraulically actuated blades are deployed on the housing, the blades disposed to extend radially outward from the housing and engage a wall of the borehole, said engagement of the blades with the borehole wall operative to eccenter the housing in the borehole. The steering tool housing further includes a hydraulic pressure sensor, at least one formation evaluation sensor, and a tool face sensor deployed therein. The method further includes causing the tool face sensor to measure a tool face angle of the formation evaluation sensor, processing the measured tool face angle to acquire a target hydraulic pressure, causing the hydraulic pressure sensor to measure a hydraulic pressure in the housing, comparing the target hydraulic pressure with the measured hydraulic pressure, opening at least one valve when the measured hydraulic pressure is greater than the target hydraulic pressure.

In a further aspect the present invention includes a method of geosteering. The method includes deploying a steering tool in a subterranean borehole, the steering tool including a housing deployed about a shaft, the housing and the shaft free to rotate relative to one another about a longitudinal axis of the steering tool. A plurality of blades are deployed on the housing, the blades disposed to extend radially outward from the housing and engage a wall of the borehole, said engagement of the blades with the borehole wall operative to eccenter the housing in the borehole. The steering tool housing further includes at least one formation evaluation sensor and a tool face sensor deployed therein. The method further includes causing the housing to rotate in the borehole at substantially a predetermined rotation rate, causing the at least one formation evaluation sensor and the tool face sensor to acquire a plurality of data pairs, each data pair comprising at least one formation evaluation measurement and a corresponding tool face angle and processing the acquired data pairs to construct a borehole image. The method still further includes processing the borehole image to acquire at least one image parameter and evaluating the at least one image parameter to control a direction of drilling, the direction of drilling being controlled via controlling extension and retraction of the blades.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
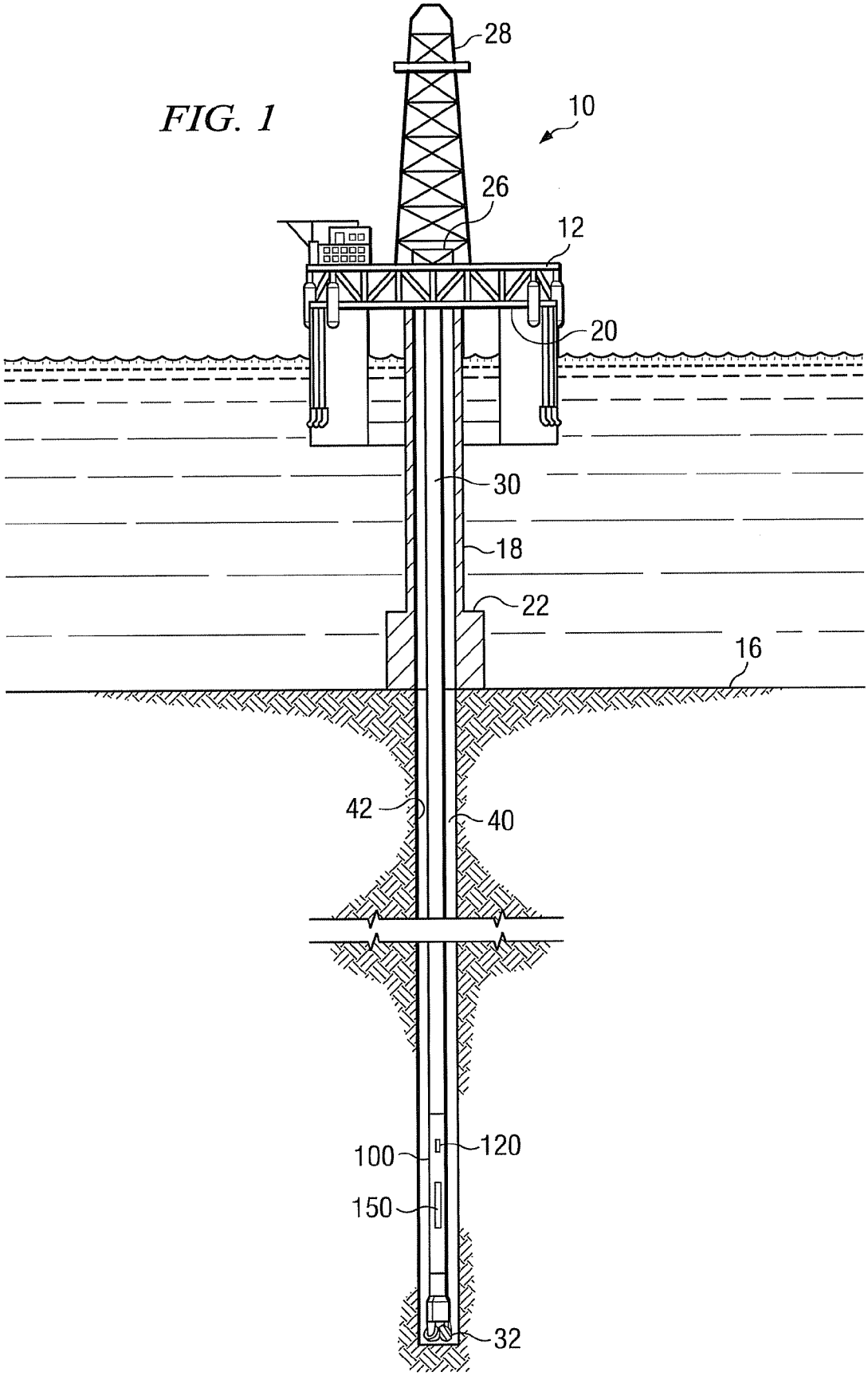
FIG. 1 depicts a drilling rig on which exemplary embodiments of the present invention may be deployed.

Referring first to FIGS. 1 through 4B, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 4B may be described herein with respect to that reference numeral shown on other views.

Figure 2:
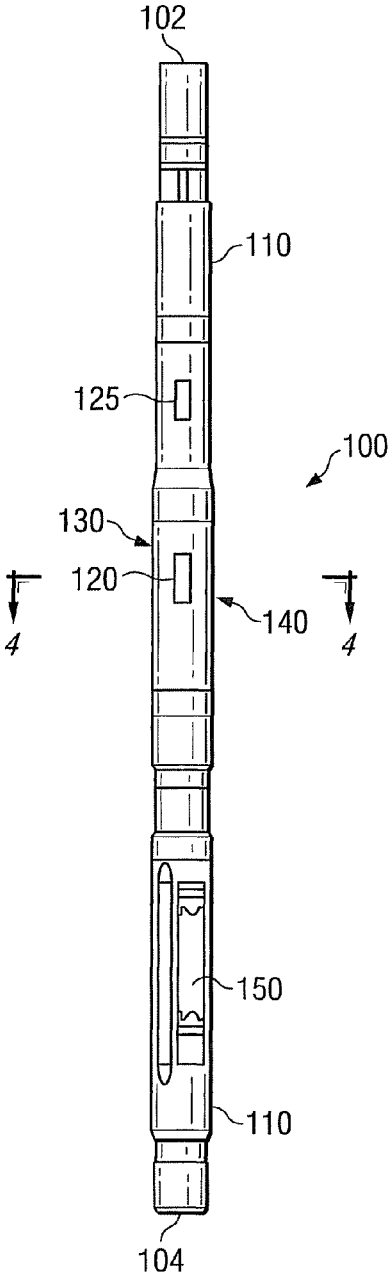
FIG. 2 is a perspective view of one exemplary embodiment of the steering tool shown on FIG. 1.

FIG. 1 illustrates a drilling rig 10 suitable for utilizing exemplary downhole steering tool and method embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a steering tool 100 (such as a three-dimensional rotary steerable tool). In the exemplary embodiment shown, steering tool 100 includes a plurality of blades 150 (e.g., three) disposed to extend outward from the tool 100. The extension of the blades 150 into contact with the borehole wall 42 is intended to eccenter the tool in the borehole, thereby changing an angle of approach of the drill bit 32 (which changes the direction of drilling). Steering tool 100 further includes at least one (and preferably a plurality of) formation evaluation sensor(s) 120 deployed in an outer housing 110 (FIG. 2). Drill string 30 may further include other known components, for example, including a downhole drilling motor, a mud pulse telemetry system, additional LWD or MWD sensors, and the like. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore.

Turning now to FIG. 2, one exemplary embodiment of steering tool 100 from FIG. 1 is illustrated in perspective view. In the exemplary embodiment shown, steering tool 100 is substantially cylindrical and includes threaded ends 102 and 104 (threads not shown) for connecting with other bottom hole assembly (BHA) components (e.g., connecting with the drill bit at end 104 and upper BHA components at end 102). The steering tool 100 further includes a shaft 115 (FIGS. 3, 4A, and 4B) deployed in a housing 110. The shaft 115 is connected with the drill string 30 and is disposed to transfer both torque and weight to the bit 32 (FIG. 1). The housing 110 is constructed in a rotationally non-fixed (floating) fashion with respect to the shaft 115. A plurality of blades 150 are deployed, for example, in corresponding recesses (not shown) in the housing 110. Steering tool 100 further includes a plurality of formation evaluation (FE) sensors 120 deployed in housing 110. FE sensors 120 may also be referred to herein as LWD sensors. FE sensors 120 typically include one or more of the following: gamma ray sensors, natural gamma ray sensors, spectral density sensors, neutron density sensors, inductive and galvanic resistivity sensors, micro-resistivity sensors, acoustic velocity sensors, and the like. Preferred FE sensor embodiments are discussed in more detail herein below with respect to FIGS. 4A and 4B. Steering tool 100 further includes hydraulics 130 and electronics 140 modules (also referred to herein as control modules 130 and 140) deployed in the housing 110. In general (and as described in more detail below with respect to FIG. 3), the control modules 130 and 140 are configured for measuring and controlling the relative positions of the blades 150 as well as the hydraulic system and blade pressures. Control modules 130 and 140 may include substantially any devices known to those of skill in the art, such as those disclosed in U.S. Pat. No. 5,603,386 to Webster or U.S. Pat. No. 6,427,783 to Krueger et al. Electronic control module 140 also includes FE sensors 120 and associated electronics.

Steering tool 100 may be used in directional drilling operations (including geosteering applications) to steer drill bit 32 along a predetermined drilling path. To steer (i.e., change the direction of drilling), one or more of blades 150 are extended and exert a force against the borehole wall. The steering tool 100 is moved away from the center of the borehole by this operation, altering the drilling path. It will be appreciated that the tool 100 may also be moved back towards the borehole axis if it is already eccentered. In general, increasing the offset (i.e., increasing the distance between the tool axis and the borehole axis) tends to increase the curvature (dogleg severity) of the borehole upon subsequent drilling. In the exemplary embodiment shown, steering tool 100 is configured for "push-the-bit" steering in which the direction (tool face) of subsequent drilling tends to be the same (or nearly the same; depending, for example, upon local formation characteristics) as the offset between the tool axis and the borehole axis. The invention is not limited to a push-the-bit configuration. It is equally well suited for "point-the-bit" steering in which a near-bit stabilizer is utilized and the direction of subsequent drilling tends to be opposite the offset between the tool axis and borehole axis.

As described above, shaft 115 and housing 110 are configured to rotate substantially freely with respect to one another. To facilitate controlled steering, the housing 110 preferably is substantially non-rotating or slowly rotating with respect to the borehole. By keeping the blades 150 in a substantially fixed position with respect to the circumference of the borehole (i.e., by limiting rotation of the housing 110), it is possible to steer the tool without constantly extending and retracting the blades 150. During a typical drilling operation, housing 110 typically rotates slowly in the borehole (e.g., at a rate in the range from about 0.1 to about 30 revolutions per hour). In order to accommodate the slow rotation of housing 110 and maintain a predetermined drilling direction, adjustments are typically made to the blade positions during drilling.

Figure 3:
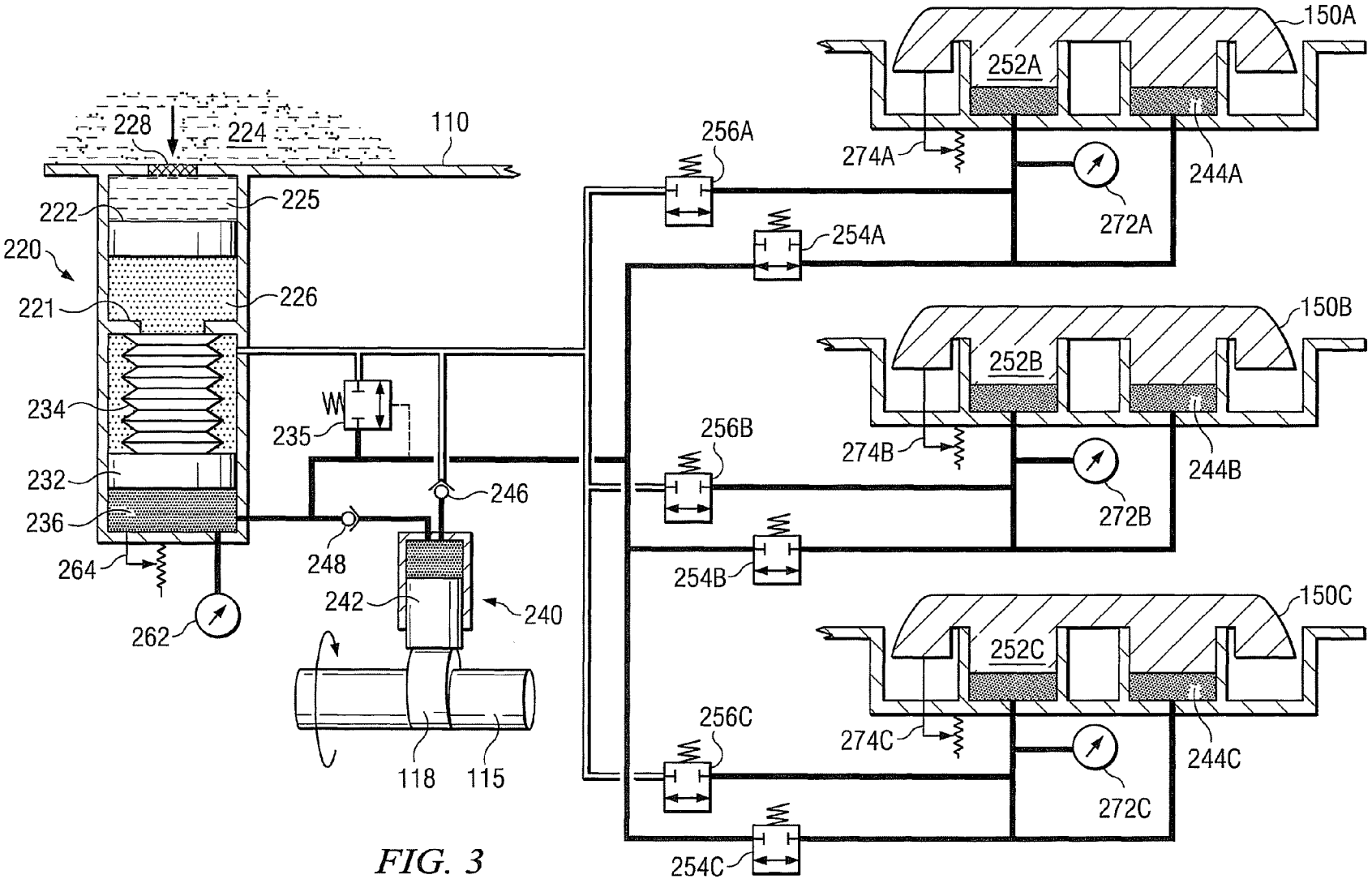
FIG. 3 depicts a schematic diagram of an exemplary hydraulic control module employed in exemplary embodiments of the steering tool shown on FIG. 2.

With reference now to FIG. 3, one exemplary embodiment of hydraulic module 130 is schematically depicted. FIG. 3 shows blades 150A, 150B, and 150C as well as certain of the electrical control devices (which are in electronic communication with electronic control module 140). Hydraulic module 130 (FIG. 2) includes a hydraulic fluid chamber 220 including first and second, low and high pressure reservoirs 226 and 236. In the exemplary embodiment shown, low pressure reservoir 226 is modulated to wellbore (hydrostatic) pressure via equalizer piston 222. Wellbore drilling fluid 224 enters fluid cavity 225 through filter screen 228, which is deployed in the outer surface of the non-rotating housing 110. It will be readily understood by those of ordinary skill in the art that the drilling fluid in the borehole exerts a force on equalizer piston 222 proportional to the wellbore pressure, which thereby pressurizes hydraulic fluid in low pressure reservoir 226.

Hydraulic module 130 further includes a piston pump 240 operatively coupled with drive shaft 115. In the exemplary embodiment shown, pump 240 is mechanically actuated by a cam 118 formed on an outer surface of drive shaft 115, although the invention is not limited in this regard. Pump 240 may be equivalently actuated, for example, by a swash plate mounted to the outer surface of the shaft 115 or an eccentric profile formed in the outer surface of the shaft 115. In the exemplary embodiment shown, rotation of the drive shaft 115 causes cam 118 to actuate piston 242, thereby pumping pressurized hydraulic fluid to high pressure reservoir 236. Piston pump 240 receives low pressure hydraulic fluid from the low pressure reservoir 226 through inlet check valve 246 on the down-stroke of piston 242 (i.e., as cam 118 disengages piston 242). On the upstroke (i.e., when cam 118 engages piston 242), piston 242 pumps pressurized hydraulic fluid through outlet check valve 248 to the high pressure reservoir 236. It will be understood that the invention is not limited to any particular pumping mechanism. In other embodiments, an electric powered pump may be utilized, for example, powered via electrical power generated by a mud turbine or from batteries such as lithium batteries.

Hydraulic fluid chamber 220 further includes a pressurizing spring 234 (e.g., a Belleville spring) deployed between an internal shoulder 221 of the chamber housing and a high pressure piston 232. As the high pressure reservoir 236 is filled by pump 240, high pressure piston 232 compresses spring 234, which maintains the pressure in the high pressure reservoir 236 at some predetermined pressure above wellbore pressure. Hydraulic module 130 typically (although not necessarily) further includes a pressure relief valve 235 deployed between high pressure and low pressure fluid lines. In one exemplary embodiment, a spring loaded pressure relief valve 235 opens at a predetermined differential pressure (e.g., about 750 psi), thereby limiting the pressure of the high pressure reservoir 236 a predetermined amount above wellbore pressure. However, the invention is not limited in this regard.

With continued reference to FIG. 3, extension and retraction of the blades 150A, 150B, and 150C are now described. Blades 150A, 150B, and 150C are essentially identical and thus the configuration and operation thereof are described only with respect to blade 150A. Blades 150B and 150C are referred to below in reference to exemplary hydraulic control methods that may be utilized in exemplary embodiments of the invention. Blade 150A includes one or more blade pistons 252A deployed in corresponding chambers 244A, which are in fluid communication with both the low and high pressure reservoirs 226 and 236 through controllable valves 254A and 256A, respectively. In the exemplary embodiment shown, valves 254A and 256A include solenoid controllable valves, although the invention is not limited in this regard.

In order to extend blade 150A (radially outward from the tool body), valve 254A is opened and valve 256A is closed, allowing high pressure hydraulic fluid to enter chamber 244A. As chamber 244A is filled with pressurized hydraulic fluid, piston 252A is urged radially outward from the tool, which in turn urges blade 150A outward (e.g., into contact with the borehole wall). When blade 150A has been extended to a desired (predetermined) position, valve 254A may be closed, thereby "locking" the blade 150A in position (at the desired extension from the tool body).

In order to retract the blade (radially inward towards the tool body), valve 256A is open (while valve 254A remains closed). Opening valve 256A allows pressurized hydraulic fluid in chamber 244A to return to the low pressure reservoir 226. Blade 150A may be urged inward (towards the tool body), for example, via spring bias and/or contact with the borehole wall. In the exemplary embodiment shown, the blade 150A is not drawn inward under the influence of a hydraulic force, although the invention is not limited in this regard.

Hydraulic module 130 may also advantageously include one or more sensors, for example, for measuring the pressure and volume of the high pressure hydraulic fluid. In the exemplary embodiment shown on FIG. 3, sensor 262 is disposed to measure hydraulic fluid pressure in reservoir 236. Likewise, sensors 272A, 272B, and 272C are disposed to measure hydraulic fluid pressure at blades 150A, 150B, and 150C, respectively. Position sensor 264 is disposed to measure the displacement of high pressure piston 232 and therefore the volume of high pressure hydraulic fluid in reservoir 236. Position sensors 274A, 274B, and 274C are disposed to measure the displacement of blade pistons 252A, 252B, and 252C and thus the extension of blades 150A, 150B, and 150C. In one exemplary embodiment of the invention, sensors 262, 272A, 272B, and 272C each include a pressure sensitive strain gauge, while sensors 264, 274A, 274B, and 274C each include a potentiometer having a resistive wiper, however, the invention is not limited in regard to the types of pressure and volume sensors utilized.

In the exemplary embodiments shown and described with respect to FIG. 3, hydraulic module 130 utilizes pressurized hydraulic oil in reservoirs 226 and 236. The artisan of ordinary skill will readily recognize that the invention is not limited in this regard and that pressurized drilling fluid, for example, may also be utilized to extend blades 150A, 150B, and 150C.

Figure 4A:
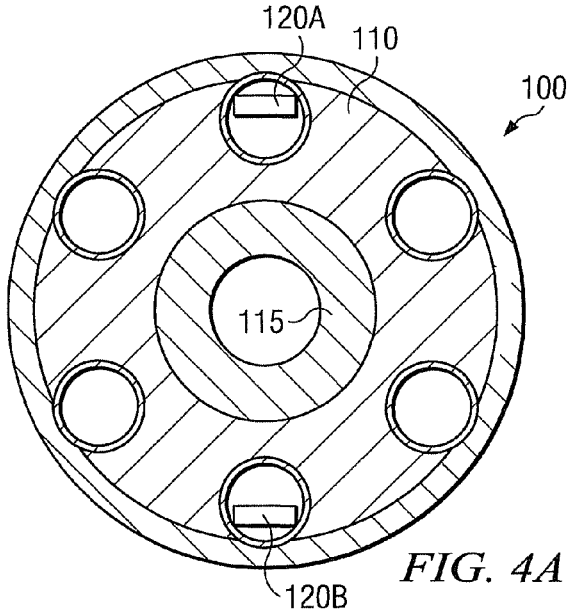
FIGS. 4A and 4B depict circular cross sectional views of exemplary LWD sensor configurations in the steering tool shown on FIG. 2.
Figure 4B:
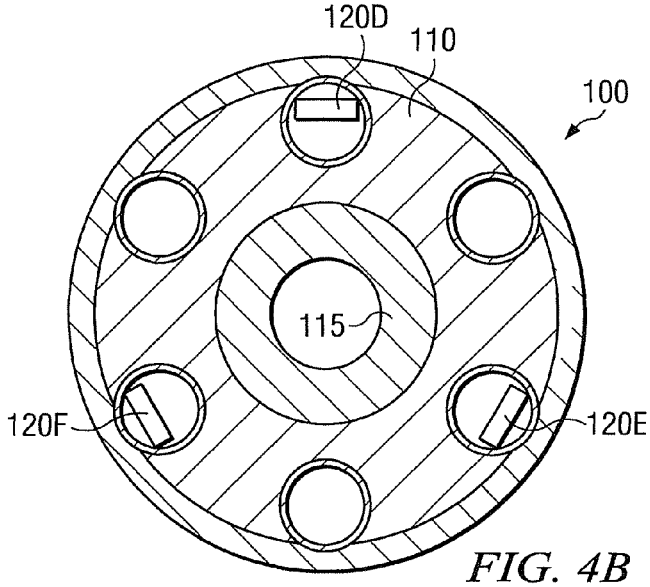

Referring now to FIGS. 4A and 4B, preferred steering tool embodiments are described in more detail. As described above, exemplary embodiments of the invention include a plurality of FE sensors (e.g., sensors 120A and 120B in the preferred embodiment shown on FIG. 4A or sensors 120D, 120E, and 120F in the preferred embodiment shown on FIG. 4B).

FIG. 4A depicts a preferred embodiment including first and second azimuthally focused FE sensors deployed on circumferentially opposing sides of housing 110. In a most preferred embodiment, FE sensors 120A and 120B include azimuthally focused gamma ray sensors. In such an embodiment (in which FE sensors 120A and 120B include gamma ray sensors), steering tool 100 typically further includes a radiation source (not shown). The invention is not limited in this regard, however, since natural gamma ray sensors may be utilized to measure naturally occurring gamma ray emissions.

Figure 5:
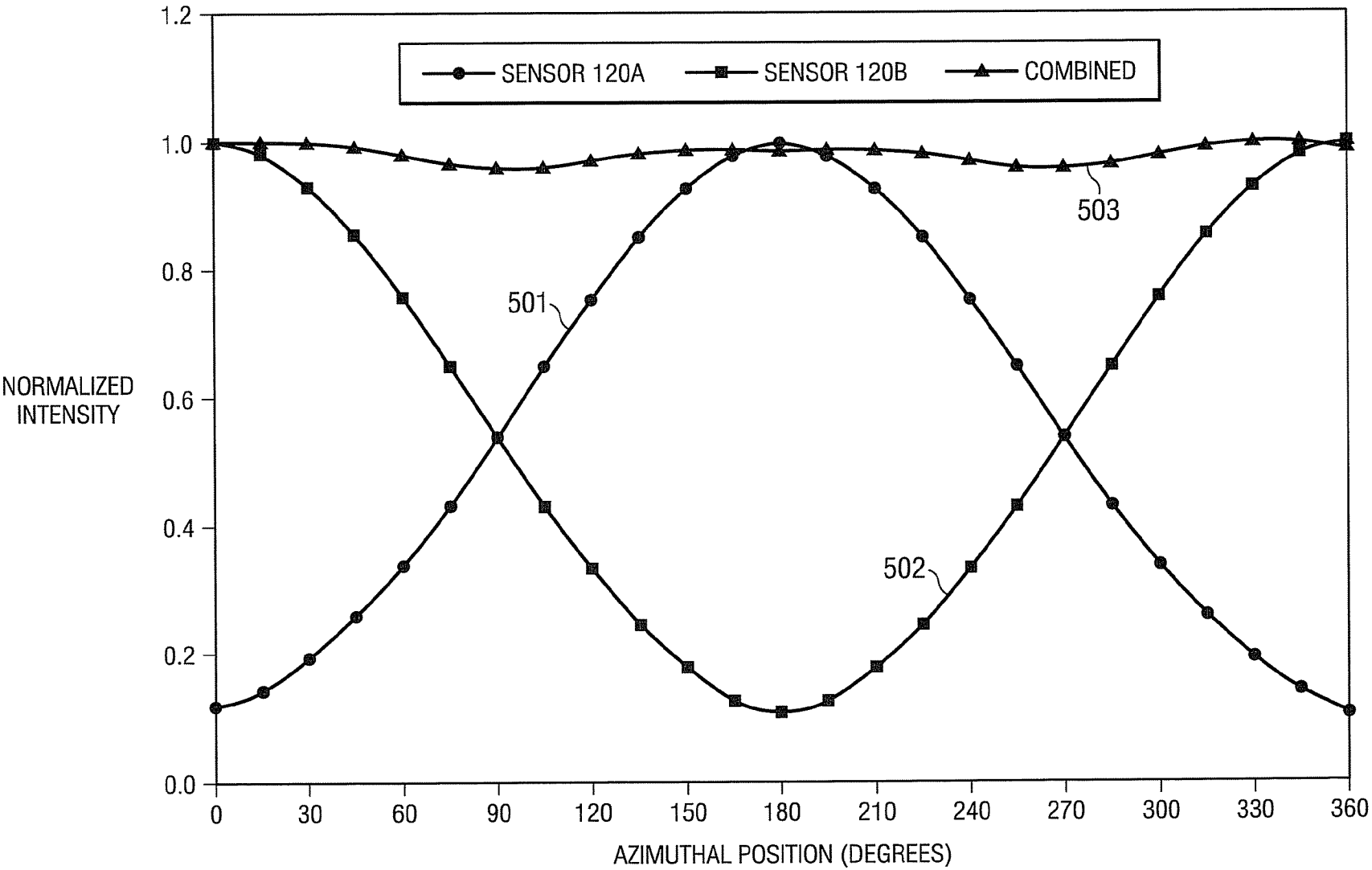
FIG. 5 depicts a plot of normalized LWD sensor intensity as a function of azimuthal position about the circumference of the steering tool for exemplary LWD sensors configured as shown on FIG. 4A.

With further reference to FIG. 5, the preferred FE sensor arrangement depicted in FIG. 4A may advantageously be utilized to acquire both azimuthal and non-azimuthal sensor responses. Gamma ray sensors 120A and 120B may be configured to have an approximately bell-shaped sensor responses as a function of the tool face angle (e.g., an approximately Gaussian function). The exemplary sensor response functions 501 and 502 depicted on FIG. 5 may be fit using a suitable Gaussian type function having a background normalized intensity of about 0.1. FIG. 5 plots the normalized sensor intensity as a function of tool face angle (azimuthal position about the circumference of the tool) for the preferred embodiment of the invention depicted on FIG. 4A. Along the tool face axis (the x-axis in FIG. 5), sensor 120A has a peak response at about zero degrees (at the center of the gamma ray photo-multiplier tube). Sensor 120B has a peak response at about 180 degrees (also at the center of the gamma ray photo-multiplier tube). In order to obtain azimuthally sensitive LWD sensor data, sensor responses 501 and 502 may be evaluated individually or compared with one another (for example via subtracting one from the other).

In the preferred embodiment depicted in FIGS. 4A and 5, the combined sensor response 503 (i.e., the sum of sensor response 501 and sensor response 502) is substantially independent of the tool face angle (azimuthal position about the tool). As depicted, the variation in sensor response about the circumference of the tool is less 1%, which is within the statistical uncertainty of a Monte Carlo simulation model. The sensor response may therefore be considered to be essentially flat with tool face. In this preferred embodiment, the combined sensor response is configured to be essentially non-azimuthal, for example, by proper positioning of the gamma ray sensors (photo-multiplier tubes) in the tool housing 110 and/or proper selection of the geometry and composition of the shielding materials.

With reference now to FIG. 4B, another preferred embodiment is depicted. FIG. 4B depicts a steering tool 100 including first, second, and third FE sensors 120D, 120E, and 120F deployed in tool body 110. While not shown in FIG. 4B, it will be understood that sensors 120D, 120E, and 120F are circumferentially aligned (but axially offset) with blades 150 (FIG. 2). Sensors 120D, 120E, and 120F are preferably neutron density sensors, although the invention is not limited in this regard.

As is known to those of ordinary skill in the art, nuclear logging measurements are particularly degraded with increasing standoff distance (the distance between the FE sensor and the borehole wall) due to neutron scattering in the borehole fluids in the annulus between the sensor and formation. Therefore, a measurement of the standoff distance between the sensor and borehole wall is important in order to properly weight the acquired sensor data. Prior art neutron density logging tools often utilize simultaneous ultrasonic standoff measurements as the tool is rotating in the borehole. Alignment of the standoff sensor with the neutron sensors provides a determination of the standoff distance between the neutron sensors in the formation. While such prior art techniques are commercially serviceable, there are drawbacks. For example ultrasonic standoff tools are known to provide inaccurate or unreliable standoff measurements in certain borehole environments and drilling fluids. Ultrasonic caliper tools also tend to be expensive and prone to shock and vibration related failure during operation in harsh borehole environments. They also have difficulty measuring a reliable standoff when there are gas bubbles in the drilling fluid.

The preferred embodiment depicted in FIG. 4B advantageously overcomes the above described drawbacks of the prior art by utilizing the blades 150 to make real-time physical caliper/standoff measurements. In other words, a physical standoff measurement may be computed in real time during drilling or reaming operations based on the radial position (the degree of extension) of each of the blades 150 (the larger the blade extension the larger the standoff distance at the corresponding circumferentially aligned sensor). It will therefore be appreciated that mechanical standoff (and caliper) measurements may be calculated substantially simultaneously with the FE sensor measurements. In this way, timely, reliable, and accurate standoff measurements may be made simultaneously with the neutron density sensor measurements.

The steering tool 100 described above with respect FIGS. 2 and 4 may be advantageously utilized, for example, in geosteering applications. For example, as described in more detail below, a controller may be configured to control the force of at least one of the blades 150 against the borehole wall in order to control the rolling speed (rotation rate) of housing 110 with respect the borehole. As also described in more detail below, such control enables the circumferential (azimuthal) position of the FE sensor(s) to be controlled which provides for an optimum azimuthal FE sensor response.

During a typical directional drilling application (e.g., a geosteering application), a steering command may be received at steering tool 100, for example, via drill string rotation encoding. Exemplary drill string rotation encoding schemes are disclosed, for example, in commonly assigned U.S. Pat. Nos. 7,222,681 and 7,245,229. Upon receiving the steering command (which may be, for example, in the form of transmitted offset and tool face values), new blade positions are typically calculated and each of the blades 150A, 150B, and 150C is independently extended and/or retracted to its appropriate position (as measured by displacement sensors 274A, 274B, and 274C). Two of the blades (e.g., blades 150B and 150C) are preferably locked into position as described above (valves 254B, 254C, 256B, and 256C are closed) with respect to FIG. 3. The third blade (e.g., blade 150A) preferably remains "floating" (i.e., open to high pressure hydraulic fluid via valve 256A) in order to maintain a grip on the borehole wall so that housing 110 is substantially non-rotating or slowing rotating during drilling.

It has been found that the rotation rate of the housing 110 with respect to the borehole is approximately inversely related to the force of the floating blade (e.g., blade 150A) against the borehole wall. In other words, the rotation rate of the housing 110 tends to increase with decreasing floating blade force and decrease with increasing floating blade force. Therefore, in order to increase the rotation rate of the housing 110, the force applied to the floating blade may be decreased. Alternatively, in order to decrease the rotation rate of the housing 110, the force applied to the floating blade may be increased. It will be appreciated that it is typically necessary to maintain some minimum applied force to the floating blade so as not to degrade the steerability of the tool 100 (the blade force of the floating blade has also been found to effect the steerability of the tool 100 as is described in more detail in commonly assigned, U.S. application Ser. No. 11/595,054 now U.S. Pat. No. 7,464,770).

In one exemplary embodiment of the invention, the blade force of the floating blade may be controlled by controlling the system pressure of the hydraulic fluid used to extend the blades 150. For clarity of exposition, control of the hydraulic fluid pressure will be described for a tool configuration in which blade 150A is floating and blades 150B and 150C are locked in their predetermined positions (as described above). The invention is, of course, not limited in this regard. As described above with respect to FIG. 3, the system pressure in reservoir 236 may be maintained at a constant pressure (e.g., 750 psi) above well bore pressure via pressure relief valve 235. At a system pressure of 750 psi above wellbore pressure, it has been found that the rotation rate of housing 110 is often less than one revolution per hour (e.g., from about 0.1 to about 1 revolution per hour). In order to increase the rotation rate of the housing 110, the system pressure (in reservoir 236) may be decreased, for example, by "short-circuiting" high-pressure reservoir 236 with low-pressure reservoir 226 through the floating blade 150A by opening valve 256A.

Figure 6:
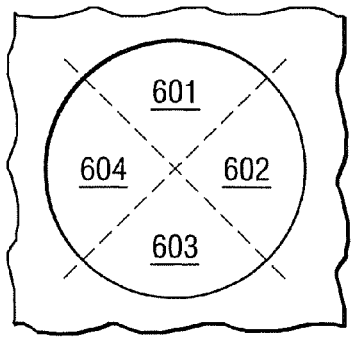
FIG. 6 depicts a cross-sectional view of a borehole having four quadrants.
Figure 7:
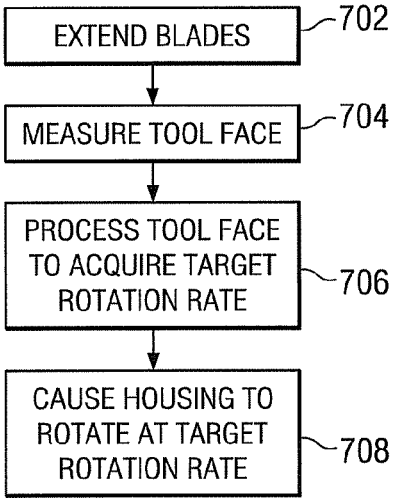
FIGS. 7 and 8 depict exemplary closed loop geosteering methods in accordance with the present invention.

An exemplary geosteering operation is now described in more detail with respect to FIGS. 6 and 7. FIG. 6 depicts a circular cross section of a subterranean borehole having four quadrants (e.g., referred to herein as high side 601, right side 602, the low side 603, and left side 604). In one common type of geosteering application, a borehole is routed through an approximately horizontal oil-bearing reservoir (e.g., having an inclination in the range from about 80 to about 100 degrees). A directional drilling tool is configured to change the drilling course when the on-board formation evaluation sensors detect the formation boundary (above or below the directional drilling tool). In such applications, it is advantageous for the azimuthal FE sensor(s) to detect formation contrast between high side 601 and low side 603 of the borehole or between the high 601 and/or low 603 sides and a non-azimuthal measurement. In this type of geosteering application, FE sensor measurements made towards the right side 602 and left side 604 are comparatively less important. As described above, steering tool 100 may be configured to control the rolling speed (rotation rate) of housing 110 in the borehole. In the above-described geosteering application, it is desirable for the FE sensors to spend more time in quadrants 601 and 603 than in quadrants 602 and 604 of the borehole. Therefore, in one exemplary embodiment of the invention, steering tool 100 may be configured to increase the blade force (of the floating blade) when the FE sensors 120 begin to enter quadrants 601 and 603 and to reduce the blade force when the FE sensors 120 depart into quadrants 602 and 604 so the housing 110 rotates relatively slowly when the sensors 120 are in quadrants 601 and 603 and relatively quickly when the sensors 120 are in quadrants 602 and 604.

It will be appreciated that the housing 110 rotates significantly slower than the drill string. Therefore accelerometers may be advantageously utilized to measure the sensor tool face. The use of gravity-based sensors tend to be advantageous in steering tool 100 embodiments (as opposed to magnetometers) since the housing is often fabricated from at least some Ferro-magnetic materials. The invention is not limited in this regard, however, since magneto-sensitive devices (e.g. magnetometers) and/or gyroscopic sensors (e.g. mechanical gyro) can be used to obtain tool face angle.

Figure 8:
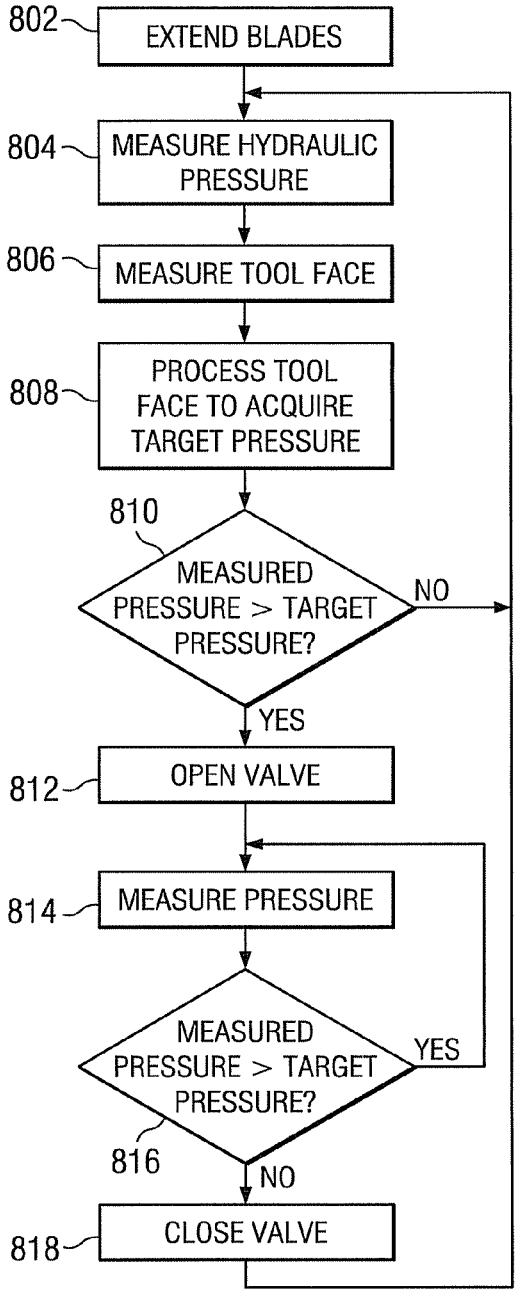

FIGS. 7 and 8 depict exemplary closed loop geosteering methods in accordance with the present invention. FIG. 7 depicts a more general embodiment, while FIG. 8 depicts a preferred embodiment of the invention. In the method depicted in FIG. 7, the steering tool is deployed in the borehole and the steering tool blades 150 are extended into engagement with the borehole wall at 702. At 704, a controller causes the tool face angle (azimuthal position) of the FE sensor to be measured. At 706, the controller processes the tool face angle measured at 704 to acquire (or select) a target rotation rate (or rotation rate range) of the housing 110 in the borehole. At 708, the controller causes the housing to rotate at the target rotation rate (or within the range of rates). In one exemplary embodiment of the invention the controller causes the housing 110 to rotate at a first ration rate in the borehole when the measured tool face is in a first predetermined range and a second rotation rate when the measured tool face is in a second predetermined range. For example, the controller may cause the housing to rotate at a relatively fast first rotation rate in the range from about 1 to about 15 revolutions per hour when the measured tool face is in a right side or left side quadrant (quadrants 602 or 604 in FIG. 6) and at a relatively slow second rotation rate in the range from about 0.1 to about 1 revolution per hour when the measured tool face is in a high side or low side quadrant (quadrants 601 or 603 in FIG. 6).

It will be appreciated that the rotation rate of the housing 110 in the borehole may be controlled by controlling the extendable blades deployed in the housing. For example, in one exemplary embodiment, the housing may be made to rotate at the first rotation rate by causing at least one of the blades to engage the borehole wall at a first radial force and at the second rotation rate by causing the blade(s) to engage the borehole wall at a second radial force (with the first radial force being less than the second radial force). As described above, the rotation rate of the housing 110 typically decreases with increasing blade force. It will be understood that the blade force applied to the borehole wall may be controlled using either type of directional control mechanism described above in the Background Section of commonly assigned, co-pending U.S. Patent Application Publication 2008/0110674.

In a preferred embodiment of the method depicted in FIG. 7, the blades 150 are hydraulically actuated and receive hydraulic oil from a central system reservoir (e.g., reservoir 236 depicted in FIG. 3). In such an embodiment, the controller may cause the housing to rotate at the first rotation rate by causing the hydraulic oil in the system reservoir to be at a first hydraulic pressure. The housing may be made to rotate at the second rotation rate by causing the hydraulic oil in the system reservoir to be at a second hydraulic pressure, wherein the first hydraulic pressure is less than the second hydraulic pressure. It will be appreciated (as described above) that increasing the pressure in the system reservoir tends to increase the blade force and therefore decrease the rotation rate of the housing.

As stated above, FIG. 8 depicts a preferred geosteering method in accordance with the present invention. In the method depicted in FIG. 8, the steering tool is deployed in the borehole and the steering tool blades 150 are extended into engagement with the borehole wall at 802 where two of the blades are preferably locked in place (in the manner described above with respect to FIG. 3). At 804 and 806, respectively, a controller causes a hydraulic system pressure and the tool face angle of the formation evaluation sensor to be measured. At 808, the controller processes the tool face angle measured at 806 to acquire (or select) a target hydraulic system pressure. At 810, the pressure measured at 804 is compared with the target pressure acquired at 808. If the measured pressure is greater than the target pressure, then the controller causes a valve (e.g., valve 256A shown on FIG. 3) to be opened which reduces the system pressure (e.g., the pressure in reservoir 236). In the most preferred embodiment (when valve 256A is opened) the system pressure is reduced by short circuiting high pressure fluid (e.g., the fluid in reservoir 236) with lower pressure fluid (the fluid in low-pressure reservoir 226) through one of the blades (e.g., blade 150A). If the measured system pressure is less than or equal to the target system pressure, the controller waits some predetermined time (e.g., one second) before returning to step 804 and repeating the above-described process.

After a predetermined time (e.g., 1 second), the blade pressure is measured again and is compared with the target pressure (at 814 and 816). If the pressure measured at 814 is less than or equal to the target pressure acquired at 808, the valve is closed at 818 and the controller returns to step 804 at which the hydraulic pressure is again measured after some predetermined time. If the measured pressure remains greater than the target pressure, the valve is left open and the controller waits for a predetermined time before repeating steps 814 and 816.

The target system pressure may be acquired at step 808 using substantially any suitable protocol. For example, the controller may be preprogrammed to include first and second, upper and lower target system pressures. When the measured tool face of a preselected one of the sensors 120 is in either of the high side or low side quadrants 601 or 603 (FIG. 6), the controller may select the first, upper target system pressure thereby causing the housing 110 to rotate at a relatively slow rate (e.g., less than one revolution per hour). When the measured tool face is in either of the right side or left side quadrants 602 or 604, the controller may select the second, lower target system pressure thereby causing the housing 110 to rotate at a relatively faster rate (e.g., greater than one revolution per hour). In this manner, sensors 120 will more quickly rotate out of quadrants 602 and 604 back into quadrants 601 and 603 (where they are most needed). It will be appreciated that the invention is not limited to the above-described exemplary embodiment. Those of ordinary skill in the art will readily be able to conceive of and implement other schemes for controlling the rotation rate of steering tool housing 110. For example, system pressure/blade force may be selected to be a predefined continuous or semi-continuous function of the measured sensor tool face. In such an exemplary embodiment, the system may be configured, for example, to apply the highest blade force at tool face angles of 0° and 180° and the lowest blade force at tool face angles of 90° and 270° (i.e., the function may have maxima at 0° and 180° and minima at 90° and 270°).

It will further be appreciated that the system pressure may also be controlled via implementing a controllable system valve (e.g., a solenoid valve) in place of (or in parallel with) pressure relieve valve 235 (FIG. 3). In such a configuration, the method of FIG. 8 is configured to respectively open and close the system valve. In a configuration in which the system valve replaces pressure relief valve 235, the system pressure may be controlled over substantially any suitable range of pressures. The invention is expressly not limited to the means by which the hydraulic system pressure is controlled. For example, in other alternative embodiments, the system pressure may be controlled via a controllable pump (e.g., a local piston pump) or other means known in the downhole arts.

It will be understood that the closed loop geosteering methods depicted in FIGS. 7 and 8 typically further include additional method steps directed towards acquiring and evaluating formation evaluation measurements and utilizing those measurements to control the direction of drilling (e.g., via changing the position of at least one of the blades). In an exemplary embodiment utilizing first and second circumferentially opposed gamma ray sensors (e.g., sensors 120A and 120B on FIG. 4A), the difference or ratio between high side and low side counts may be utilized to sense bed boundaries above or below the tool. When the difference or ratio is outside a predetermined range of values (indicative of an approaching bed boundary), the direction of drilling may be appropriately changed so as to stay in the desired formation. For example, a ratio of high side to low side gamma ray counts above a first predetermined threshold may be taken to be indicative of an approaching bed boundary above the steering tool. The tool may thus be configured to change the direction of drilling downward when the count ratio is above the first threshold (e.g., via changing the position of at least one of the blades). Likewise, a ratio of high side to low side counts below a second predetermined threshold may be taken to be indicative of an approaching bed boundary below the steering tool. The tool may thus be configured to change the direction of drilling upward when the count ratio is below the second threshold. Alternatively, a ratio between the high side measurement and a non-azimuthal measurement (made for example as described above via summing or averaging the measurements at each of the FE sensors) and/or a ratio between the low side measurement and a non-azimuthal measurement may be used to determine the location of an approaching bed boundary.

Steering tool embodiments in accordance with the present invention may also be utilized to acquire formation evaluation images, which may be further utilized in geosteering applications. For example, the radial force on at least one of the blades 150 may be controlled such that housing 110 rotates at an approximately constant rate in the borehole. In general, a relatively fast, approximately constant rotation rate is desirable for acquiring images. A rotation rate in the range from about 5 to about 30 revolutions per hour has been found to be suitable for such formation evaluation imaging applications. Rotation rates less than about five revolutions per hour tend to be too slow for imaging applications at most serviceable rates of penetration. Rotation rates greater than about 30 revolutions per hour may adversely affect the steerability of the steering tool (since very low blade forces tend to be required). Rotation rates greater than about 30 revolutions per hour also tend to require a large hydraulic fluid pumping capacity in order to continually adjust the position of the blades.

In such imaging applications, formation evaluation measurements may be acquired and correlated with corresponding tool face measurements while the housing 110 rotates in the borehole. The formation evaluation measurements and corresponding tool face measurements may be used to construct a borehole image using substantially any know methodologies, for example, conventional binning, windowing, or probability distribution algorithms. U.S. Pat. No. 5,473,158 discloses a conventional binning algorithm for constructing a borehole image. Commonly assigned U.S. Pat. No. 7,027,926 discloses a technique for constructing a borehole image in which sensor data is convolved with a one-dimensional window function. Commonly assigned, U.S. patent application Ser. No. 11/881,043 (now U.S. Pat. No. 7,558,675) describes an image constructing technique in which sensor data is probabilistically distributed in either one or two dimensions. It will be appreciated by those of ordinary skill in the art that a borehole image is essentially a two-dimensional representation of a measured formation (or borehole) parameter as a function of sensor tool face and measured depth of the borehole.

The constructed borehole images may be evaluated uphole and/or downhole using techniques known to those of ordinary skill in the art. The evaluated borehole images may then be used as the basis for steering decisions (i.e., blade adjustment decisions). For example, the ratio of high side gamma ray counts to low side gamma ray counts may be obtained from the constructed borehole image and may be used to control the direction of drilling in the manner described above. Moreover, evaluation of the borehole image may advantageously enable a formation dip angle to be determined. The dip angle is known to those of ordinary skill in the art to be the tilt angle of the subterranean formation relative to the surface of the earth. The dip angle acquired from the borehole image may also be used as a basis for steering decisions.

With reference again to FIG. 2, the control modules 130 and 140 may include a digital programmable processor such as a microprocessor or a microcontroller and processor-readable or computer-readable programming code embodying logic, including instructions for controlling the function of the steering tool 100 (including implementing the method embodiments of FIG. 7 and/or FIG. 8). Substantially any suitable digital processor (or processors) may be utilized, for example, including an ADSP-2191M microprocessor, available from Analog Devices, Inc.

In the exemplary embodiments shown above, modules 130 and 140 are in electronic communication with pressure sensors 262, 272A, 272B, 272C and displacement sensors 264, 274A, 274B, 274C. Modules 130 and 140 are further in electronic communication with valves 235, 254A-C, and 256A-C. The control modules 130 and 140 may further include instructions to receive rotation and/or flow rate encoded commands from the surface and to cause the steering tool 100 to execute such commands upon receipt. Module 140 typically further includes at least one tri-axial arrangement of accelerometers as well as instructions for computing gravity tool face and borehole inclination (as is known to those of ordinary skill in the art). Such computations may be made using either software or hardware mechanisms (using analog or digital circuits). Electronic module 140 may also further include one or more sensors for measuring the rotation rate of the drill string (such as accelerometer deployments and/or Hall-Effect sensors) as well as instructions executing rotation rate computations. Exemplary sensor deployments and measurement methods are disclosed, for example, in commonly assigned, U.S. Patent Publications 2007/0107937 and 2007/0289373.

Electronic module 140 typically includes other electronic components, such as a timer and electronic memory (e.g., volatile or non-volatile memory). The timer may include, for example, an incrementing counter, a decrementing time-out counter, or a real-time clock. Module 140 may further include a data storage device, various other sensors, other controllable components, a power supply, and the like. Electronic module 140 is typically (although not necessarily) disposed to communicate with other instruments in the drill string, such as telemetry systems that communicate with the surface and an LWD tool including various other formation sensors. Electronic communication with one or more LWD tools may be advantageous, for example, in geo-steering applications. One of ordinary skill in the art will readily recognize that the multiple functions performed by the electronic module 140 may be distributed among a number of devices.

Although the present invention and its advantages have been described in detail, it should be understood that various changes, substitutions and alternations can be made herein without departing from the spirit and scope of the invention as defined by the appended claims.

We claim:

1. A downhole steering tool configured to operate in a borehole, the steering tool comprising:

a shaft deployed substantially coaxially in a housing, the shaft and the housing being free to rotate relative to one another about a longitudinal axis of the steering tool;

a plurality of blades deployed on the housing, the blades disposed to extend radially outward from the housing and engage a wall of the borehole, said engagement of the blades with the borehole wall operative to eccenter the housing in the borehole;

at least first and second circumferentially opposed gamma ray sensors deployed in the housing, each of the gamma ray sensors being configured to individually provide a corresponding azimuthally focused sensor response, the gamma ray sensors being configured to collectively provide a non-azimuthally focused sensor response; and a controller configured to acquire sensor data from the gamma ray sensors and to compute both azimuthally focused and non-azimuthally focused formation evaluation measurements.

2. The steering tool of claim 1, wherein the controller is configured to compute the non-azimuthally focused sensor response via summing the azimuthally focused sensor responses.

3. The steering tool of claim 1, wherein the gamma ray sensors are configured such that the azimuthally focused sensor response is a substantially bell-shaped function of tool face angle.

4. The steering tool of claim 3, wherein a sum of the azimuthally focused sensor responses of the gamma ray sensors is substantially independent of the tool face angle.

5. A downhole steering tool configured to operate in a borehole, the steering tool comprising:

a shaft deployed substantially coaxially in a housing, the shaft and the housing being free to rotate relative to one another about a longitudinal axis of the steering tool;

a plurality of blades deployed on the housing, the blades disposed to extend radially outward from the housing and engage a wall of the borehole, said engagement of the blades with the borehole wall operative to eccenter the housing in the borehole;

a plurality of circumferentially spaced formation evaluation sensors deployed in the housing, each of the formation evaluation sensors being configured to individually provide a corresponding azimuthally focused sensor response, the plurality of formation evaluation sensors being configured to collectively provide a non-azimuthally focused sensor response; and a controller configured to (i) acquire sensor data from the formation evaluation sensors and to compute both azimuthally focused and non-azimuthally focused formation evaluation measurements and (ii) control a rotation rate of the housing in a subterranean borehole by controlling a radial force with which at least one of the blades engages the borehole wall.

6. The steering tool of claim 5, wherein the controller controls the radial force by controlling a system hydraulic pressure in the housing.

7. A downhole steering tool configured to operate in a borehole, the steering tool comprising:

a shaft deployed substantially coaxially in a housing, the shaft and the housing being free to rotate relative to one another about a longitudinal axis of the steering tool;

at least first, second, and third blades deployed on the housing, the blades disposed to extend radially outward from the housing and engage a wall of the borehole, said engagement of the blades with the borehole wall operative to eccenter the housing in the borehole;

at least first, second, and third circumferentially spaced formation evaluation sensors deployed in the housing, each of the first, second, and third formation evaluation sensors being axially spaced from and circumferentially aligned with a corresponding one of the first, second, and third blades;

a controller configured to compute a standoff distance at each of the formation evaluation sensors based on a radial position of the corresponding blades.

8. The steering tool of claim 7, wherein the first, second, and third formation evaluation sensors comprise first, second, and third neutron density sensors.

9. The steering tool of claim 7, wherein the controller is further configured to compute the standoff distances while substantially simultaneously causing the first, second, and third formation evaluation sensors to make formation evaluation measurements.

10. A method for geosteering comprising:

(a) deploying a steering tool in a subterranean borehole, the steering tool including a housing deployed about a shaft, the housing and the shaft free to rotate relative to one another about a longitudinal axis of the steering tool, a plurality of blades deployed on the housing, the blades disposed to extend radially outward from the housing and engage a wall of the borehole, said engagement of the blades with the borehole wall operative to eccenter the housing in the borehole; the steering tool housing further including (i) at least one formation evaluation sensor and (ii) a tool face sensor deployed therein;

(b) causing the tool face sensor to measure a tool face angle of the formation evaluation sensor;

(c) processing the tool face angle measured in (b) to determine a target rotation rate of the housing in the borehole; and (d) causing the housing to rotate in the borehole at about the target rotation rate.

11. The method of claim 10 wherein (c) and (d) in combination comprise:

causing the housing to rotate at a first rotation rate in the borehole when the tool face measured in (b) is in a first predetermined range of values; and causing the housing to rotate at a second rotation rate in the borehole when the tool face measured in (b) is in a second predetermined range of values, the first rotation rate being greater than the second rotation rate.

12. The method of claim 11, wherein the first rotation rate is in the range from about 1 to about 15 revolutions per hour and the second rotation rate is in the range from about 0.1 to about 1 revolutions per hour.

13. The method of claim 11, wherein the first predetermined range of tool face values correspond to right side and left side quadrants and the second predetermined range of tool face values correspond to high side and low side quadrants.

14. The method of claim 11, wherein:

causing the housing to rotate at the first rotation rate comprises causing at least one the blades to engage the wall of the borehole at a first radial force; and causing the housing to rotate at the second rotation rate comprises causing the at least one the blades to engage the wall of the borehole at a second radial force, the first radial force being less than the second radial force.

15. The method of claim 11, wherein:

the blades are hydraulically actuated, receiving hydraulic oil from a system chamber;

causing the housing to rotate at the first rotation rate comprises causing the hydraulic oil in the system chamber to be at a first hydraulic pressure; and causing the housing to rotate at the second rotation rate comprises causing the hydraulic oil in the system chamber to be at a second hydraulic pressure, the first hydraulic pressure being less than the second hydraulic pressure.

16. The method of claim 10, wherein the steering tool comprises first and second circumferentially opposed formation evaluation sensors deployed in the housing, the method further comprising:

(e) causing the first and second formation evaluation sensors to make corresponding first and second formation evaluation measurements;

(f) computing a ratio or a difference between the first and second formation evaluation measurements; and (g) causing a direction of drilling to be changed when the ratio or difference computed in (f) is outside a predetermined range of values.

17. The method of claim 10, wherein the steering tool comprises a plurality of circumferentially spaced formation evaluation sensors deployed in the housing, the method further comprising:

(e) causing the plurality of formation evaluation sensors to make a corresponding plurality of formation evaluation measurements;

(f) computing a substantially non-azimuthally focused measurement from the plurality of formation evaluation measurements made in (e);

(g) computing a ratio or a difference between at least one of the plurality of formation evaluation measurements made in (e) and the non-azimuthally focused measurement computed in (f); and (h) causing a direction of drilling to be changed when the ratio or difference computed in (g) is outside a predetermined range of values.

18. A method for geo-steering comprising:

(a) deploying a steering tool in a subterranean borehole, the steering tool including a housing deployed about a shaft, the housing and the shaft free to rotate relative to one another about a longitudinal axis of the steering tool, a plurality of hydraulically actuated blades deployed on the housing, the blades disposed to extend radially outward from the housing and engage a wall of the borehole, said engagement of the blades with the borehole wall operative to eccenter the housing in the borehole; the steering tool housing further including (i) a hydraulic pressure sensor, (ii) at least one formation evaluation sensor, and (iii) a tool face sensor deployed therein;

(b) causing the tool face sensor to measure a tool face angle of the formation evaluation sensor;

(c) processing the tool face angle measured in (b) to acquire a target hydraulic pressure;

(d) causing the hydraulic pressure sensor to measure a hydraulic pressure in the housing;

(e) comparing the target hydraulic pressure acquired in (c) with the hydraulic pressure measured in (d); and (f) opening at least one valve when the hydraulic pressure measured in (d) is greater than the target hydraulic pressure acquired in (c).

19. The method of claim 18, wherein opening the at least one valve in (f) is operative to reduce a radial force applied by at least one of the blades to the borehole wall.

20. The method of claim 18, wherein opening the at least one valve in (f) is operative to increase a rotation rate of the housing in the borehole.

21. The method of claim 20, wherein opening the at least one valve in (f) is operative to increase the rotation rate of the housing and the borehole from a rotation rate in the range from about 0.1 to about 1 revolution per hour to a rotation rate in the range from about 1 to about 15 revolutions per hour.

22. The method of claim 18, further comprising:

(g) closing the at least one valve when the hydraulic pressure measured in (d) is less than or equal to the target hydraulic pressure acquired in (c).

23. The method of claim 18, wherein a first target hydraulic pressure is selected when the measured tool face angle corresponds to right side and left side quadrants and a second target hydraulic pressure is selected when the measured tool face corresponds to high side and low side quadrants, the second target hydraulic pressure being greater than the first target hydraulic pressure.

24. The method of claim 18, wherein the steering tool comprises first and second circumferentially opposed formation evaluation sensors deployed in the housing, the method further comprising:

(g) causing the first and second formation evaluation sensors to make corresponding first and second formation evaluation measurements;

(h) computing a ratio or a difference between the first and second formation evaluation measurements; and (i) causing a direction of drilling to be changed when the ratio or difference computed in (h) is outside a predetermined range of values.

25. The method of claim 18, wherein the steering tool comprises a plurality of circumferentially spaced formation evaluation sensors deployed in the housing, the method further comprising:

(g) causing the plurality of formation evaluation sensors to make a corresponding plurality of formation evaluation measurements;

(h) computing a substantially non-azimuthally focused measurement from the plurality of formation evaluation measurements made in (g);

(i) computing a ratio or a difference between at least one of the plurality of formation evaluation measurements made in (g) and the non-azimuthally focused measurement computed in (h); and (j) causing a direction of drilling to be changed when the ratio or difference computed in (i) is outside a predetermined range of values.

26. A method for geo-steering comprising:

(a) deploying a steering tool in a subterranean borehole, the steering tool including a housing deployed about a shaft, the housing and the shaft free to rotate relative to one another about a longitudinal axis of the steering tool, a plurality of blades deployed on the housing, the blades disposed to extend radially outward from the housing and engage a wall of the borehole, said engagement of the blades with the borehole wall operative to eccenter the housing in the borehole; the steering tool housing further including (i) at least one formation evaluation sensor, and (ii) a tool face sensor deployed therein;

(b) causing the housing to rotate in the borehole at substantially a predetermined rotation rate;

(c) causing the at least one formation evaluation sensor and the tool face sensor to acquire a plurality of data pairs, each data pair comprising at least one formation evaluation measurement and a corresponding tool face angle;

(d) processing the data pairs acquired in (c) to construct a borehole image;

(e) processing the borehole image to acquire at least one image parameter; and (f) evaluating the at least one image parameter to control a direction of drilling, the direction of drilling being controlled via controlling extension and retraction of the blades.

27. The method of claim 26, wherein the rotation rate of the housing is in the range from about 5 to about 30 revolutions per hour.

28. The method of claim 26, wherein the at least one image parameter comprises at least one of a dip angle, a ratio or difference between a high side formation evaluation measurement and a low side formation evaluation measurement, a ratio or a difference between a high-side formation evaluation measurement and a substantially non-azimuthally focused formation evaluation measurement, and a ratio or a difference between a low-side formation evaluation measurement and a substantially non-azimuthally focused formation evaluation measurement.

29. A logging while drilling method comprising:

(a) deploying a steering tool in a subterranean borehole, the steering tool including a housing deployed about a shaft, the housing and the shaft free to rotate relative to one another about a longitudinal axis of the steering tool, first, second, and third blades deployed on the housing, the blades disposed to extend radially outward from the housing and engage a wall of the borehole, said engagement of the blades with the borehole wall operative to eccenter the housing in the borehole; the steering tool housing further including first, second, and third formation evaluation sensors axially offset from and circumferentially aligned with a corresponding one of the blades;

(b) extending each of the blades to a corresponding predetermined radial position;

(c) computing a standoff distance for each of the sensors from the radial position of the corresponding blade;

(d) causing the formation evaluation sensors to make corresponding formation evaluation measurements substantially simultaneously with the computing of the standoff distances in (c); and (e) processing the formation evaluation measurements measured in (d) with the corresponding standoff distances computed in (c) to obtain weighted formation evaluation measurements.

* * * * *